US005848644A

United States Patent [19]

Velly et al.

[11] Patent Number: 5,848,644

[45] Date of Patent: Dec. 15, 1998

[54] PROCESS FOR REDUCING THE TENDENCY OF HYDRATES TO AGGLOMERATE IN PRODUCTION EFFLUENTS CONTAINING PARAFFIN OILS

[75] Inventors: Marie Velly; Anne-Sophie Delion, both of Paris; Jean-Pierre Durand, Chatou, all of France

[73] Assignee: Institut Francais du Petrole, France

[21] Appl. No.: 874,949

[22] Filed: Jun. 13, 1997

[30] Foreign Application Priority Data

Jun. 14, 1996 [FR] France ..... 9607518

[51] Int. Cl.[6] ..... E21B 43/40; E21B 43/16

[52] U.S. Cl. ..... 166/267; 166/310

[58] Field of Search ..... 166/267, 279, 166/275, 300, 310

[56] References Cited

U.S. PATENT DOCUMENTS 4,532,052 7/1985 Weaver et al. ..... 166/307 X
4,563,291 1/1986 Penny ..... 166/308 X
5,076,364 12/1991 Hale et al. ..... 166/310
5,351,756 10/1994 Minkkinen ..... 166/279 X

FOREIGN PATENT DOCUMENTS

93/25798 12/1993 WIPO .
96/04348 2/1996 WIPO .

*Primary Examiner*—Frank Tsay
*Attorney, Agent, or Firm*—Millen, White, Zelano & Branigan, P.C.

[57] ABSTRACT

The invention concerns a process for reducing the tendency of hydrates in a fluid comprising at least water, a gas and a paraffin oil to agglomerate, by addition of a mixture of at least two organosoluble additives, namely at least one polyisobutene-polyethyleneglycol block copolymer and at least one copolymer of an alkyl (meth)acrylate and a nitrogen-containing monomer. These organosoluble copolymers are generally introduced at an overall concentration of 0.05% to 5% by weight with respect to the water present in the medium.

11 Claims, No Drawings

PROCESS FOR REDUCING THE TENDENCY OF HYDRATES TO AGGLOMERATE IN PRODUCTION EFFLUENTS CONTAINING PARAFFIN OILS

The invention concerns a process for reducing the tendency of hydrates of natural gas, petroleum gas or other gases to agglomerate in a fluid comprising water in a fluid comprising water, one of said gases and at least one paraffin oil.

More particularly, it concerns a process in which a mixture of at least two additives is used, namely at least a polyisobutene-polyethyleneglycol block copolymer and at least one copolymer of an alkyl (meth)acrylate and a nitrogen-containing monomer.

Gases which form hydrates can comprise at least one hydrocarbon selected from methane, ethane, ethylene, propane, propene, n-butane and isobutane, and possibly $H_2S$ and/or $CO_2$.

Such hydrates are formed when water comes into the presence of a gas either in its free state or dissolved in a liquid phase such as a liquid hydrocarbon, and when the temperature of the mixture, including water, gas and possibly liquid hydrocarbons such as oil, drops below the thermodynamic temperature for hydrate formation, this temperature being fixed for a known gas composition and fixed pressure.

Hydrate formation is a problem, particularly in the gas and oil industry where hydrate formation conditions can be satisfied. One way of reducing the production costs of crude oil and gas both from the point of view of investment and exploitation, particularly in the case of offshore production, is to reduce or cut out treatments applied to the crude or gas to be transported from the field to the coast and leave all or part of the water in the fluid to be transported. Such offshore treatments are generally carried out on a platform located on the surface close to the field, so that the effluent, which is initially hot, can be treated before the thermodynamic hydrate formation conditions are reached due to cooling of the effluent with sea water.

However, in practice, when the thermodynamic conditions required for hydrate formation are satisfied, hydrate agglomeration causes the transport lines to block by the formation of plugs which prevent the passage of crude or gas.

The formation of hydrate plugs can stop production and result in large financial losses. Further, restarting the installation, especially in the case of offshore production or sea transportation, can be a long process as the hydrates formed are very hard to decompose. When the production from a submarine natural gas or oil and gas field containing water reaches the surface of the sea bed and is transported along the sea bottom, the reduction in the temperature of the effluent produced can mean that the thermodynamic hydrate formation conditions are satisfied and the hydrates formed bind together or agglomerate and block the transfer lines. The temperature on the sea bed can, for example, be 3° C. or 4° C.

Favourable conditions for hydrate formation can also be satisfied onshore when, for example, the ambient air temperature is low and the lines are not buried, or are not deeply buried in the ground.

In order to overcome these disadvantages, the prior art has sought to use substances which, when added to the fluid, can act as inhibitors by reducing the thermodynamic hydrate formation temperature. Such substances include alcohols such as methanol, or glycols such as mono-, di- or triethyleneglycol. Such a solution is very expensive as the quantity of inhibitors to be added can be as high as 10% to 40% of the water content and those inhibitors are hard to recover completely.

Insulation of the transport lines has also been recommended, to prevent the temperature of the transported fluid from reaching the hydrate formation temperature under the operating conditions. This type of technique is also very expensive.

Various non-ionic or anionic surfactants have also been tested for their hydration formation retarding effect in a fluid comprising a gas, in particular a hydrocarbon, and water. Examples are the article by Kuliev et al.: "Surfactants Studied as Hydrate Formation Inhibitors", Gazovoe Delo n°10, 1972, 17–19, reported in Chemical Abstracts 80, 1974, 98122r.

The use of additives which can modify the hydrate formation mechanism has also been recommended, in which instead of agglomerating rapidly with each other and forming plugs, the hydrates formed disperse in the fluid without agglomerating and without obstructing the lines. Examples are: our European patent application EP-A-0 323 774, which describes the use of non-ionic amphiphilic compounds selected from the esters of polyols and carboxylic acids, which may or may not be substituted, and compounds with an imide function; our European patent application EP-A-0 323 775, which describes the use of compounds from diethanolamides of fatty acids or fatty acid derivatives; United States patent U.S. Pat. No. 4 956 593 which describes the use of surfactants such as organic phosphates, phosphate esters, phosphonic acids, and salts and esters thereof, inorganic polyphosphates and esters thereof, also polyacrylamides and polyacrylates; and European patent application EP-A-0 457 375, which describes the use of anionic surfactants such as alkylarylsulphonic acids and their alkali metal salts.

Amphiphilic compounds obtained by reacting at least one succinic derivative selected from the group formed by polyalkenylsuccinic acids and anhydrides with at least one polyethyleneglycol monoether have also been proposed for reducing the tendency of natural gas hydrates, petroleum gas hydrates or other gas hydrates to agglomerate (European patent application EP-A-0 582 507).

We have now discovered that, to reduce the tendency of hydrates to agglomerate in a fluid comprising water, a gas and a paraffin oil, a mixture of two or more copolymeric additives can advantageously be used, as will be defined in the following description.

Thus the invention provides a process for reducing the tendency of hydrates to agglomerate in a fluid comprising at least water, a gas and a paraffin oil under conditions in which hydrates can form from the water and the gas, characterized in that an additive composition is incorporated into said fluid which comprises at least two organosoluble constituents, namely at least one polyisobutene-polyethyleneglycol block copolymer and at least one copolymer of an alkyl (meth) acrylate and a nitrogen-containing monomer.

The term "paraffin oil" as used in the invention means a crude oil containing paraffin constituents which can crystallise when the temperature is reduced. Such oils are characterized by their crystallisation onset temperature ($T_c$), determined by differential enthalpic analysis, the amount and distribution of the n-paraffins, determined by gas chromatography, and their rheological behaviour as a function of temperature (in particular the temperature $T_B$ from which flow is no longer newtonian). The paraffin oils considered in the invention are more particularly those for which the crystallisation onset temperature $T_c$ is more than 10° C., temperature $T_B$ is more than 5° C. and the amount of n-paraffins containing 10 to 40 carbon atoms is more than 5% by weight.

The organosoluble polyisobutene-polyethyleneglycol block copolymers in the composition of mixtures used as additives in the process of the invention can be defined as comprising blocks derived from polyisobutenyl succinic anhydrides and blocks derived from polyethyleneglycols or alkyl monoethers of polyethyleneglycols. Such block polymers have been widely described in the literature. They can be prepared, for example, as described in our European patent EP-A-0 582 507, by reacting polyisobutenylsuccinic anhydrides and polyethyleneglycols or alkyl monoethers of polyethyleneglycols. The polyisobutenyl succinic anhydrides have, for example, number average molecular masses of about 500 to 5000, preferably 800 to 2000. The polyethyleneglycols and the polyethyleneglycol alkyl monoethers normally have a number average molecular mass of about 100 to 1000.

The organosoluble copolymers of alkyl (meth)acrylate and nitrogen-containing monomers considered in the compositions of additives used in the process of the invention can be defined as having a general formula of the type $(A)_n(B)_m$:

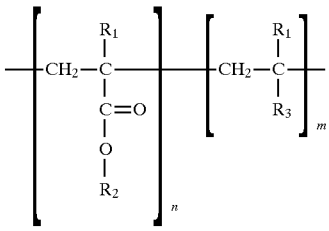

where $R_1$ is a hydrogen atom or a methyl radical, $R_2$ is an alkyl radical containing at least 10 carbon atoms and $R_3$ is a group containing nitrogen.

The type A monomer is preferably selected from alkali acrylates and methacrylates containing 18, 20, 22 or 24 carbon atoms. The type A monomers in the constitution of $(A)_n(B)_m$ copolymers are usually mixtures of monomers with differing values of $R_2$.

The type B monomer can be selected from N-vinylpyrrolidone, vinylpyridines and N-vinylimidazole, or from acrylic or methacrylic acid derivatives containing nitrogen-containing groups, such as dimethylamninoethyl acrylate or methacrylate.

The quantity of type B monomers in the $(A)_n(B)_m$ copolymers is generally in the range 2% to 50%, preferably in the range 5% to 35% in moles.

These organosoluble copolymers can have a number average molecular mass of 10000 to 100000, preferably 20000 to 70000.

These copolymers have been widely described in the literature. They can be prepared, for example, by free-radical solution copolymerisation of at least one type A monomer with at least one type B monomer.

In their use as additives to reduce the tendency of hydrates to agglomerate, mixtures of copolymers of the types described above can be added to the fluid to be treated at concentrations which are generally from 0.05% to 5% by weight, preferably 0.2% to 2% by weight, with respect to the water. The proportions of the copolymers in these mixtures are more particularly 50% to 96% of the polyisobutene-polyethyleneglycol block copolymer for 4% to 50% of the copolymer of an alkyl (meth)acrylate and a nitrogen-containing monomer.

The following examples illustrate the invention without in any way being limiting. Examples 1, 3 and 4 are given by way of comparison.

EXAMPLES

In each of the examples presented below, the effectiveness of the mixtures of the invention and the mixtures which were tested for comparison was tested by simulating transport of hydrate-forming fluids such as petroleum effluents and hydrate-formation tests were carried out from gas, paraffin oil and water using the apparatus described below.

The apparatus comprised a 10 meter closed loop constituted by tubes with an internal diameter of 7.7 mm; a 2 liter reactor with a gas inlet and outlet, and an intake and discharge for the oil, water and initially introduced additive mixture. The reactor could place the loop under pressure.

Tubes with a diameter which was analogous to that of the loop circulated the fluids from the loop to the reactor and vice versa, using a gear pump located between the two. A sapphire cell integrated in the circuit allowed the circulating liquid, and thus the hydrates if they formed, to be observed.

The effectiveness of the mixtures of additives of the invention was determined by introducing the fluids (water, oil, additive) into the reactor; the unit was then pressurised to 70 bars. The liquids were homogenised by circulating them in the loop and the reactor, then solely in the loop. The temperature was rapidly reduced from 17° C. to the hydrate formation temperature and then kept at this value, variations in the pressure drop and flow rate being monitored.

The tests lasted from several minutes to several hours: a high-performing additive allowed the hydrate suspension to keep circulating with a stable pressure drop and flow rate.

EXAMPLE 1 (comparative)

In this example, a fluid composed of 20% by volume of water and 80% by volume of paraffin oil ($T_c$=26° C., $T_B$=10° C.) was used. The gas comprised 98% by volume of methane and 2% by volume of ethane. The experiment was carried out at a pressure of 7 MPa, and held constant by addition of gas. Under these conditions, a plug was seen to form in the coil 10 minutes after hydrate formation began.

EXAMPLE 2 (in accordance with the invention)

The same fluid, the same gas and the same pressure were used in this example as in Example 1, but 1.2% by weight with respect to the water of a mixture of copolymers was added, constituted by 1% of polyisobutenyl succinate of polyethyleneglycol with an average molecular mass of close to 1500 and a polyisobutene/polyethyleneglycol weight ratio of close to 2.5 and 0.2% of an alkyl acrylate-N-vinyl pyrrolidone copolymer in which the alkyl group distribution was as follows:

$C_{16}$:5% by weight $C_{18}$:40% by weight $C_{20}$:1% by weight $C_{22}$:44% by weight The N-vinylpyrrolidone content in the copolymer was 12% by weight and its number average molecular mass was close to 55000.

Under these conditions, the pressure drop was observed to increase during hydrate formation at 4° C., followed by its reduction and stabilisation over more than 24 hours.

EXAMPLE 3 (comparative)

Example 2 was repeated, with the exception that 1.2% by weight with respect to the water of the polyisobutenyl succinate of polyethyleneglycol of Example 2 was used with no alkyl acrylate-N-vinylpyrrolidone copolymer. Under these conditions, a plug was seen to form in the coil 20 minutes after hydrate formation began.

EXAMPLE 4 (comparative)

Example 2 was repeated, with the exception that 1.2% by weight with respect to the water of the alkyl acrylate-N-vinylpyrrolidone copolymer of Example 2 was used with no polyisobutenyl succinate of polyethyleneglycol. Under these conditions, a plug was seen to form in the coil very rapidly.

EXAMPLE 5 (in accordance with the invention)

In Example 2, with everything else being the same, the alkyl acrylate-N-vinylpyrrolidone copolymer was replaced by an alkyl acrylate-4-vinylpyridine copolymer of equivalent average molecular mass and composition. As in Example 2, the fluid circulation was maintained for 24 hours with a stable pressure drop and flow rate.

EXAMPLE 6 (in accordance with the invention)

In Example 2, with everything else being the same, the alkyl acrylate-N-vinylpyrrolidone copolymer was replaced by an alkyl acrylate-N-vinylimidazole copolymer of equivalent average molecular mass and composition. As in Example 2, the fluid circulation was maintained for 24 hours with a stable pressure drop and flow rate.

We claim:

1. A process for inhibiting or retarding the formation, growth and/or agglomeration of hydrates in a fluid comprising at least water, a gas and a paraffin oil, under conditions in which hydrates can form from the water and the gas, characterized in that an organosoluble additive composition comprising at least two constituents is incorporated into said fluid, namely at least one polyisobutene-polyethyleneglycol block copolymer and at least one copolymer of an alkyl (meth)acrylate and a nitrogen-containing monomer.

2. A process according to claim 1, characterized in that said polyisobutene-polyethyleneglycol block copolymer comprises blocks derived from polyisobutenyl succinic anhydrides and blocks derived from polyethyleneglycols or alkyl monoethers of polyethyleneglycols.

3. A process according to claim 1, characterized in that said polyisobutene-polyethyleneglycol block copolymer is derived from at least one polyisobutenyl succinic anhydride with a number average molecular mass of about 500 to 5000 and at least one polyethyleneglycol or at least one polyethyleneglycol alkyl monoether with a number average molecular mass of about 100 to 1000.

4. A process according to claim 1, characterized in that said copolymer of an alkyl (meth)acrylate and a nitrogen-containing monomer has the general formula $(A)_n(B)_m$:

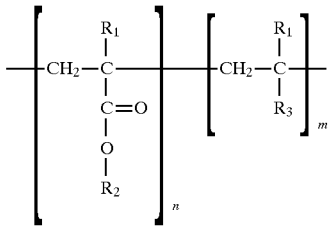

where $R_1$ is a hydrogen atom or a methyl radical, $R_2$ is an alkyl radical containing at least 10 carbon atoms and $R_3$ is a group containing nitrogen.

5. A process according to claim 4, characterized in that monomer A is selected from alkyl acrylates and methacrylates containing 18, 20, 22 or 24 carbon atoms and monomer B is selected from N-vinylpyrrolidone, vinylpyridines, N-vinylimidazole and acrylic or methacrylic acid derivatives containing nitrogen-containing groups.

6. A process according to claim 5, characterized in that monomer A consists of a mixture of monomers with different values of $R_2$.

7. A process according to claim 1, characterized in that said $(A)_n(B)_m$ copolymer has a number average molecule mass of 10000 to 100000.

8. A process according to claim 1, characterized in that said paraffin oil has a crystallisation onset temperature $T_c$ of more than 10° C., a temperature from which flow is no longer newtonian $T_B$ of more than 5° C. and the amount of n-paraffins containing 10 to 40 carbon atoms is more than 5% by weight.

9. A process according to claim 1, characterized in that in the copolymer mixture, the proportions of copolymers are 50% to 96% of polyisobutene-polyethyleneglycol block copolymer for 4% to 50% of the copolymer of an alkyl (meth)acrylate and a nitrogen-containing monomer.

10. A process according to claim 1, characterized in that the mixture of copolymers is added to the fluid in a concentration of 0.05% to 5% by weight with respect to the amount of water.

11. A process according to claim 10, characterized in that said concentration is 0.2% to 2% by weight with respect to the amount of water.

* * * * *